US010886591B1

(12) United States Patent
Lin et al.

(10) Patent No.: US 10,886,591 B1
(45) Date of Patent: Jan. 5, 2021

(54) POWER DIVIDER/COMBINER

(71) Applicant: National Chi Nan University, Puli (TW)

(72) Inventors: Yo-Sheng Lin, Puli (TW); Kai-Siang Lan, Puli (TW)

(73) Assignee: NATIONAL CHI NAN UNIVERSITY, Puli (TW)

( * ) Notice: Subject to any disclaimer, the term of this patent is extended or adjusted under 35 U.S.C. 154(b) by 0 days.

(21) Appl. No.: 16/585,928

(22) Filed: Sep. 27, 2019

(30) Foreign Application Priority Data

Jul. 19, 2019 (TW) ..... 108125566 A

(51) Int. Cl.
*H01P 5/19* (2006.01)
*H01P 3/08* (2006.01)

(52) U.S. Cl.
CPC . *H01P 5/19* (2013.01); *H01P 3/08* (2013.01)

(58) Field of Classification Search
CPC ..... H01P 5/19; H01P 5/12; H01P 3/08
See application file for complete search history.

(56) References Cited

U.S. PATENT DOCUMENTS 5,027,086 A * 6/1991 Sigmon ..... H01P 5/12 331/107 DP
6,201,439 B1 * 3/2001 Ishida ..... H01P 5/10 330/124 R
9,331,664 B2 * 5/2016 Bouisse ..... H03F 3/19
2002/0149441 A1 * 10/2002 Catoiu ..... H01P 5/12 333/116

* cited by examiner

*Primary Examiner* — Robert J Pascal
*Assistant Examiner* — Kimberly E Glenn
(74) *Attorney, Agent, or Firm* — Husch Blackwell LLP

(57) ABSTRACT

A power divider/combiner includes a first transmission line (TL) and two second TLs. The first TL has a first terminal that is for receiving or outputting a signal with a target wavelength, and a second terminal that is open circuited. Each of the second TLs is disposed adjacent to and spaced apart from the first TL so as to establish electromagnetic coupling therebetween. Each of the second TLs has a first terminal, and a second terminal that is distal from the first terminal of the first TL. The second terminals of the second TLs are for cooperatively outputting or receiving a pair of signals that have the target wavelength and that are in-phase. Each of the first and second TLs has a length that is a quarter of the target wavelength.

8 Claims, 9 Drawing Sheets

POWER DIVIDER/COMBINER

CROSS-REFERENCE TO RELATED APPLICATION

This application claims priority of Taiwanese Patent Application No. 108125566, filed on Jul. 19, 2019.

FIELD

The disclosure relates to power dividing and combining techniques, and more particularly to a power divider/combiner.

BACKGROUND

Referring to FIG. 1, a conventional Wilkinson power divider/combiner can be used as a power divider that divides an input signal with a wavelength of λ and a power magnitude of P into two output signals each with a wavelength of λ and a power magnitude of P/2, or as a power combiner that combines two input signals each with a wavelength of λ and a power magnitude of P/2 into an output signal with a wavelength of λ and a power magnitude of P.

The conventional Wilkinson power divider/combiner includes two transmission lines 11, 12 each with a length of λ/4. The transmission lines 11, 12 have to be far apart from each other to avoid electromagnetic coupling therebetween, so the conventional Wilkinson power divider/combiner disadvantageously occupies a relatively large area and has a relatively high manufacture cost. In addition, since there is no electromagnetic coupling between the transmission lines 11, 12, power consumption of the conventional Wilkinson power divider/combiner due to a substrate on which the conventional Wilkinson power divider/combiner is disposed is relatively large, resulting in relatively large total power consumption of the conventional Wilkinson power divider/combiner.

SUMMARY

Therefore, an object of the disclosure is to provide a power divider/combiner that can alleviate the drawbacks of the prior art.

According to the disclosure, the power divider/combiner includes a first transmission line and two second transmission lines. The first transmission line has a first terminal that is for receiving or outputting a signal with a target wavelength, a second terminal that is open circuited, and a length that is a quarter of the target wavelength. Each of the second transmission lines is disposed adjacent to and spaced apart from the first transmission line so as to establish electromagnetic coupling therebetween. Each of the second transmission lines has a first terminal, and a second terminal that is distal from the first terminal of the first transmission line. The second terminals of the second transmission lines are for cooperatively outputting or receiving a pair of signals that have the target wavelength and that are in-phase. Each of the second transmission lines has a length that is a quarter of the target wavelength.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
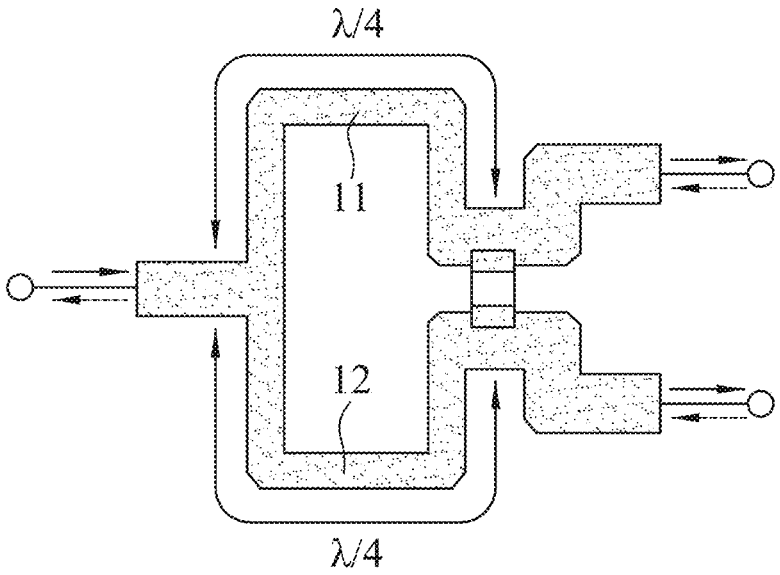
FIG.1 PRIOR ART
FIG. 1 is a structural diagram illustrating a conventional Wilkinson power divider/combiner.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
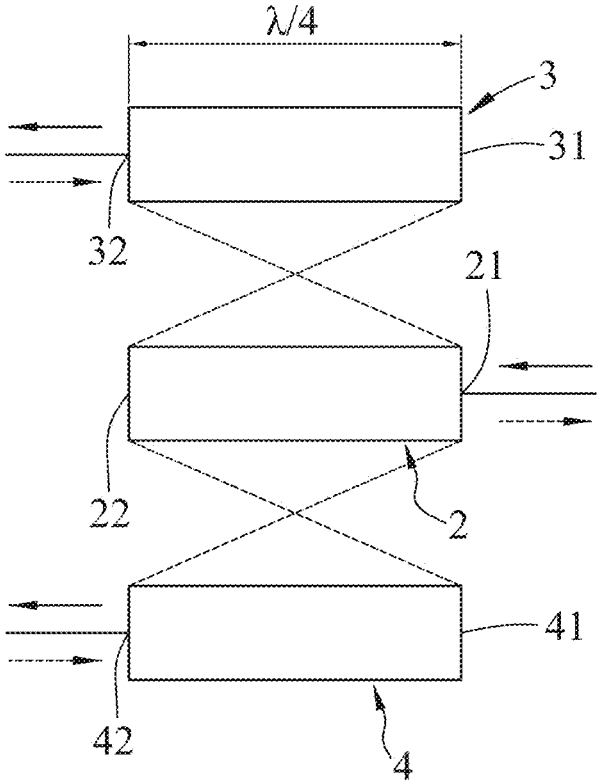
FIG. 2 is a schematic diagram illustrating a first embodiment of a power divider/combiner according to the disclosure.

Referring to FIG. 2, a first embodiment of a power divider/combiner according to the disclosure includes a first transmission line 2 and two second transmission lines 3, 4.

The first transmission line 2 has a first terminal 21 that is for receiving or outputting a signal with a target wavelength of λ, and a second terminal 22 that is open circuited. The first transmission line 2 has a length that is a quarter of the target wavelength (i.e., λ/4).

Each of the second transmission lines 3, 4 is disposed adjacent to and spaced apart from the first transmission line 2 so as to establish electromagnetic coupling therebetween. Each of the second transmission lines 3, 4 has a first terminal 31/41, and a second terminal 32/42 that is distal from the first terminal 21 of the first transmission line 2. The first terminals 31, 41 of the second transmission lines 3, 4 are open circuited. The second terminals 32, 42 of the second transmission lines 3, 4 are for cooperatively outputting or receiving a pair of signals that have the target wavelength and that are in-phase. Each of the second transmission lines 3, 4 has a length that is a quarter of the target wavelength (i.e., λ/4).

In this embodiment, the first and second transmission lines 2, 3 cooperate to form a quadrature coupler, and the first and second transmission lines 2, 4 cooperate to form another quadrature coupler. An equivalent circuit of the power divider/combiner of this embodiment is shown in FIG. 3.

Figure 3:
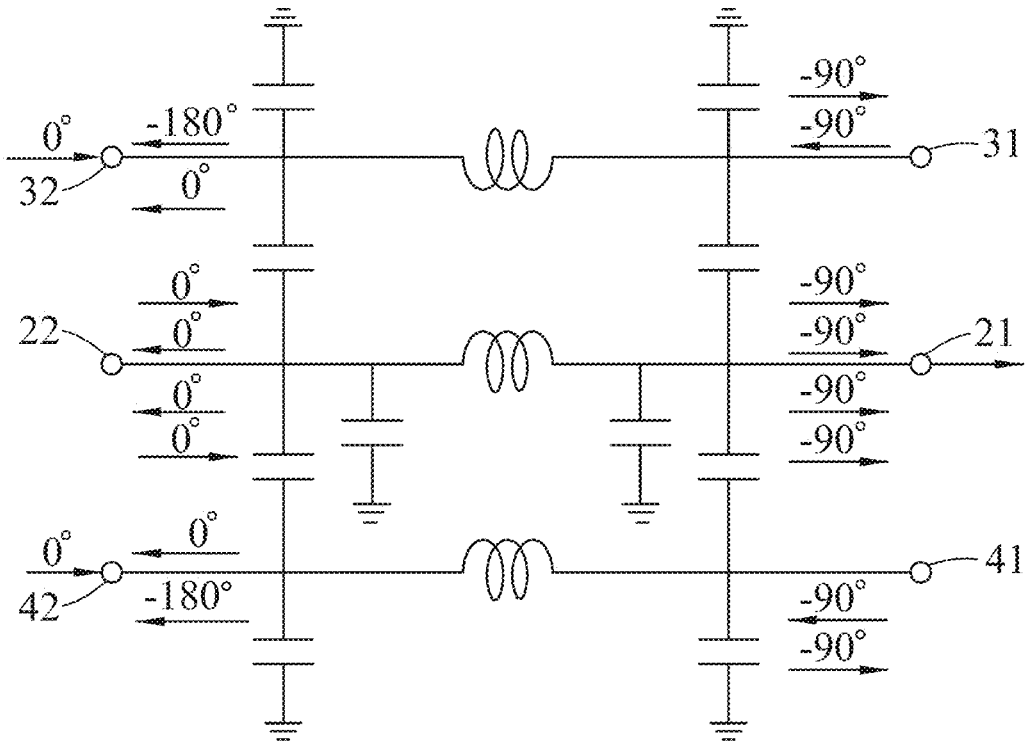
FIG. 3 is a circuit diagram illustrating an equivalent circuit of the first embodiment and phase relationships among two input signals and an output signal of the first embodiment used as a power combiner.

Referring to FIGS. 2 and 3, when the power divider/combiner of this embodiment is used as a power combiner, it receives a first input signal and a second input signal respectively at the second terminals 32, 42 of the second transmission lines 3, 4 and outputs an output signal at the first terminal 21 of the first transmission line 2. The first and second input signals have the same wavelength (i.e., the target wavelength), the same phase (i.e., the phase of 0°), and the same power magnitude of P/2, and the output signal has the target wavelength and a power magnitude of P. In detail, first, a first portion of the first input signal is transmitted on the second transmission line 3 from the second terminal 32 of the second transmission line 3 to the first terminal 31 of the second transmission line 3, has a phase of −90° at the first terminal 31 of the second transmission line 3, and is reflected at the first terminal 31 of the second transmission line 3; and a second portion of the first input signal is transmitted from the second terminal 32 of the second transmission line 3 to the second terminal 22 of the first transmission 2 through electromagnetic coupling between the first and second transmission lines 2, 3, has a phase of 0° at the second terminal 22 of the first transmission line 2, and is reflected at the second terminal 22 of the first transmission line 2. Thereafter, some of the first portion of the first input signal is transmitted on the second transmission line 3 from the first terminal 31 of the second transmission line 3 back to the second terminal 32 of the second transmission line 3, and has a phase of −180° at the second terminal 32 of the second transmission line 3; the rest of the first portion of the first input signal is transmitted from the first terminal 31 of the second transmission line 3 to the first terminal 21 of the first transmission line 2 through electromagnetic coupling between the first and second transmission lines 2, 3, and has a phase of −90° at the first terminal 21 of the first transmission line 2; some of the second portion of the first input signal is transmitted from the second terminal 22 of the first transmission line 2 back to the second terminal 32 of the second transmission line 3 through electromagnetic coupling between the first and second transmission lines 2, 3, and has a phase of 0° at the second terminal 32 of the second transmission line 3; and the rest of the second portion of the first input signal is transmitted on the first transmission line 2 from the second terminal 22 of the first transmission line 2 to the first terminal 21 of the first transmission line 2, and has a phase of −90° at the first terminal 21 of the first transmission line 2. Transmission of the second input signal in the first and second transmission lines 2, 4 can be inferred from the description above in connection with the transmission of the first input signal in the first and second transmission lines 2, 3, and details thereof are omitted herein for the sake of brevity. Finally, said some of the first portion of the first input signal and said some of the second portion of the first input signal cancel each other at the second terminal 32 of the second transmission line 3 (i.e., no signal is outputted at the second terminal 32 of the second transmission line 3), since they are anti-phase with each other at this place; some of a first portion of the second input signal and some of a second portion of the second input signal cancel each other at the second terminal 42 of the second transmission line 4 (i.e., no signal is outputted at the second terminal 42 of the second transmission line 4), since they are anti-phase with each other at this place; and the rest of the first portion of the first input signal, the rest of the second portion of the first input signal, the rest of the first portion of the second input signal and the rest of the second portion of the second input signal are combined into the output signal at the first terminal 21 of the first transmission line 2, since they are in-phase with one another at this place.

Figure 4:
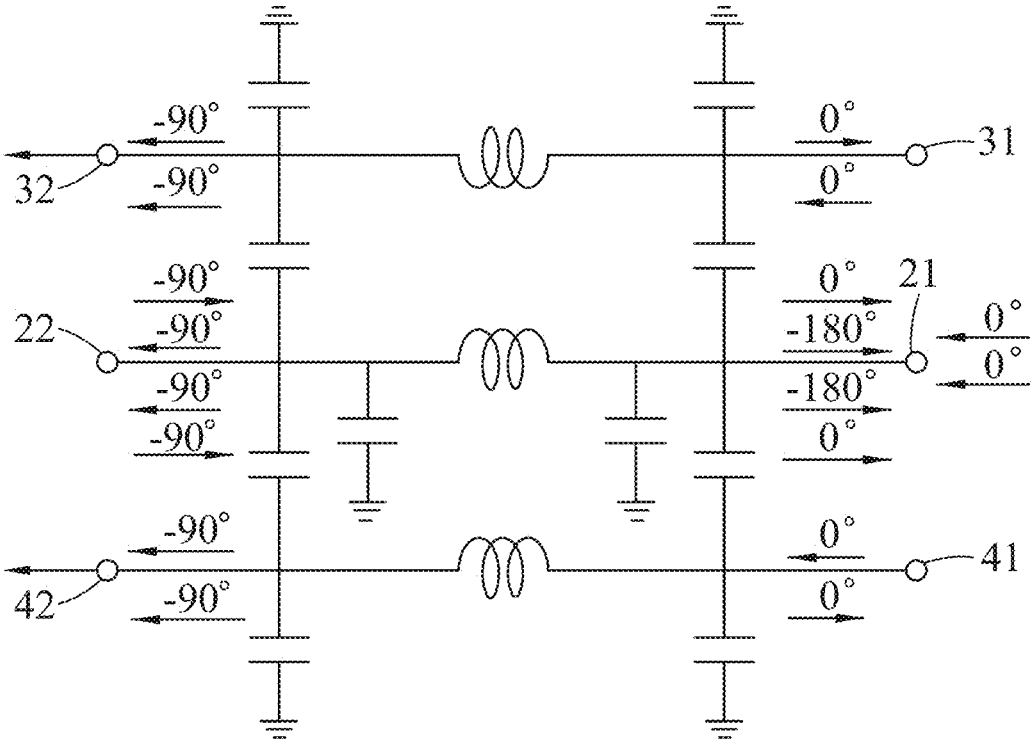
FIG. 4 is a circuit diagram illustrating phase relationships among an input signal and two output signals of the first embodiment used as a power divider.

Referring to FIGS. 2 and 4, when the power divider/combiner of this embodiment is used as a power divider, it receives an input signal at the first terminal 21 of the first transmission line 2, and outputs a first output signal and a second output signal respectively at the second terminals 32, 42 of the second transmission lines 3, 4. The input signal has the target wavelength and a power magnitude of P, and the first and second output signals have the same wavelength (i.e., the target wavelength), the same phase and the same power magnitude of P/2. The power dividing operations can be inferred from the description above in connection with the power combining operations, and details thereof are omitted herein for the sake of brevity.

Figure 5:
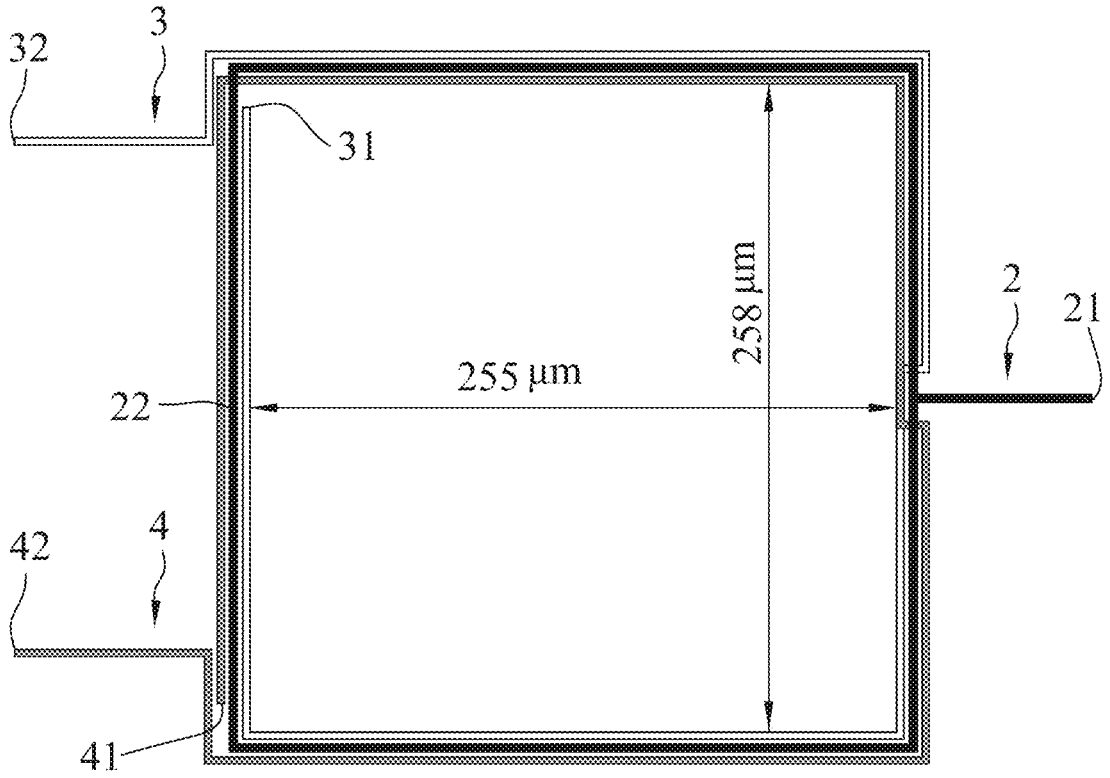
FIG. 5 is a structural diagram illustrating a first implementation of the first embodiment.
Figure 6:
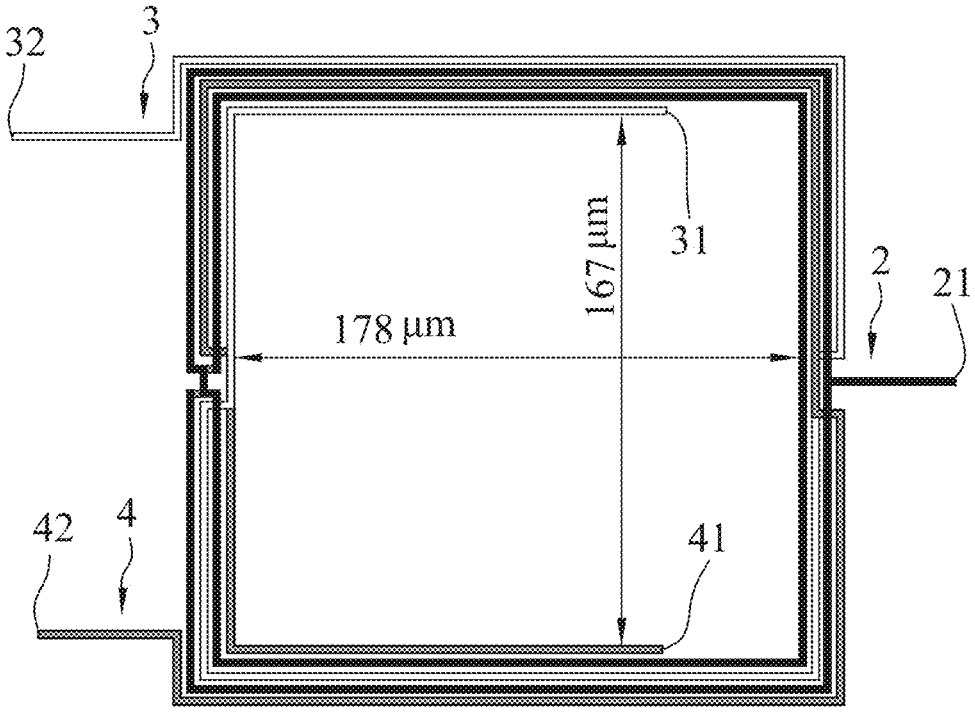
FIG. 6 is a structural diagram illustrating a second implementation of the first embodiment.

FIGS. 5 and 6 respectively illustrate a first implementation and a second implementation of the power divider/combiner of this embodiment. In each of the first and second implementation, the first and second transmission lines 2-4 are substantially coplanar, are formed mainly in a predetermined metal layer of a semiconductor process, and have the same width; the first transmission line 2 is disposed between the second transmission lines 3, 4, and is equidistant from the second transmission lines 3, 4; the first transmission line 2 is configured as a rectangular ring; and each of the second transmission lines 3, 4 is configured as a rectangular spiral that is interwound with the first transmission line 2. In the first implementation as shown in FIG. 5, each of the first and second transmission lines 2-4 has a one-turn configuration, and the power divider/combiner occupies an area of 0.079 $mm^2$ when it is designed to operate at 28 GHz (i.e., the input signal (s) is(are) 28 GHz in frequency). In the second implementation as shown in FIG. 6, each of the first and second transmission lines 2-4 has a two-turn configuration, and the power divider/combiner occupies an area of 0.046 $mm^2$ when it is designed to operate at 28 GHz. In other words, the more the turns of each of the first and second transmission lines 2-4, the smaller the occupied area of the power divider/combiner. As compared to the conventional Wilkinson power divider/combiner that occupies an area of 0.459 $mm^2$ when it is designed to operate at 28 GHz, the occupied area of the power divider/combiner of this embodiment is smaller. It should be noted that, in other implementations, the first transmission line 2 may be configured as an octagonal ring, and each of the second transmission lines 3, 4 may be configured as an octagonal spiral.

Figure 7:
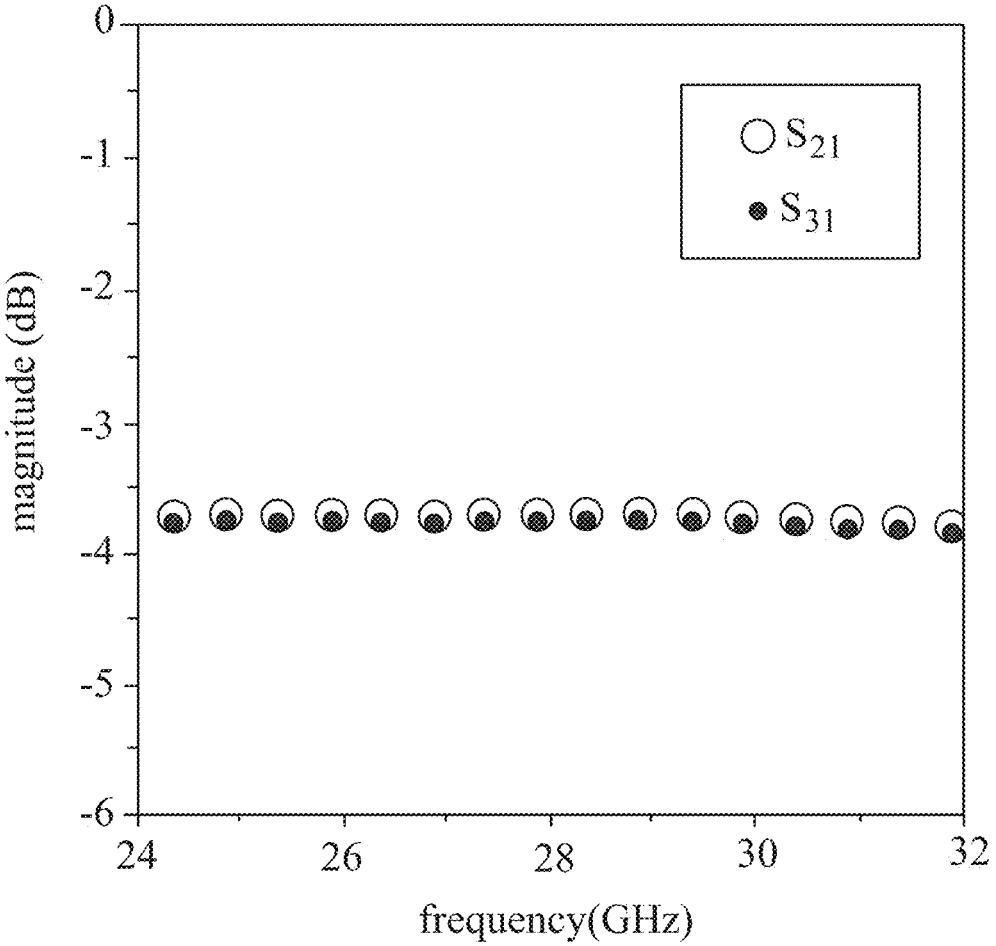
FIG. 7 is a plot illustrating magnitudes of various scattering parameters versus frequency characteristics of the first embodiment.

FIG. 7 illustrates simulation results of magnitudes a scattering parameter ($S_{21}$) from the first terminal 21 (see FIG. 2) of the first transmission line 2 (see FIG. 2) to the second terminal 32 (see FIG. 2) of the second transmission line 3 (see FIG. 2) and a scattering parameter ($S_{31}$) from the first terminal 21 (see FIG. 2) of the first transmission line 2 (see FIG. 2) to the second terminal 42 (see FIG. 2) of the second transmission line 4 (see FIG. 2) when an operation frequency of the power divider/combiner of this embodiment is within a range of 24 GHz to 32 GHz. It can be reasonably determined from FIG. 7 that the magnitude of each of the scattering parameters ($S_{21}$, $S_{31}$) approximates its ideal value of −3 dB, and that the power divider/combiner of this embodiment has small power loss.

Figure 8:
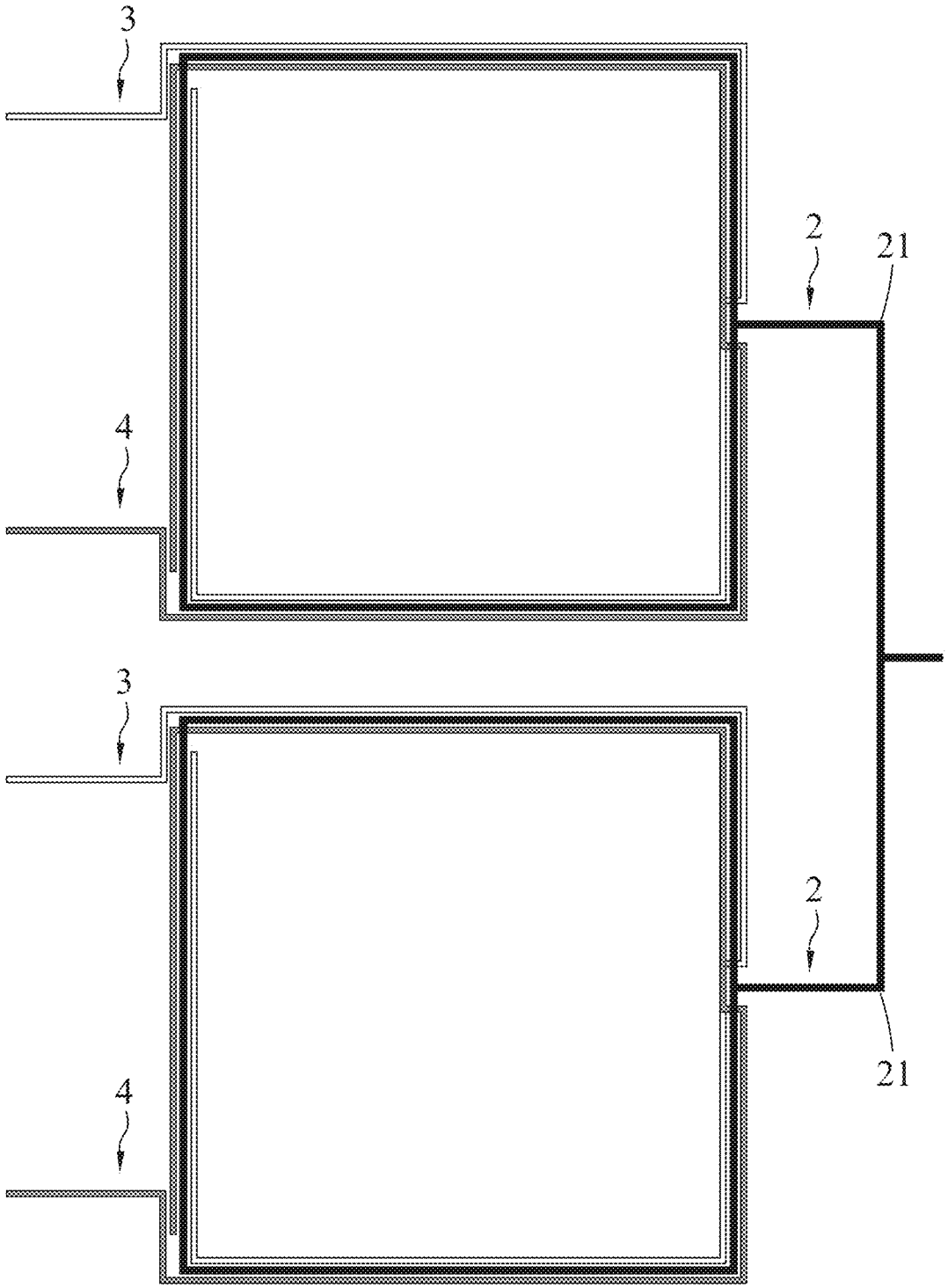
FIG. 8 is a structural diagram illustrating an application of the first implementation of the first embodiment.

It should be noted that the power divider/combiner of this embodiment is a two-way power divider/combiner. In application, as shown in FIG. 8, the first terminals 21 of the first transmission lines 2 of two power dividers/combiners of this embodiment can be connected to form a four-way power divider/combiner, with the first and second transmission lines 2-4 adjusted in dimensions for impedance matching. Of course, more than two power dividers/combiners of this embodiment can be connected to form a power divider/combiner with more than four ways.

Figure 9:
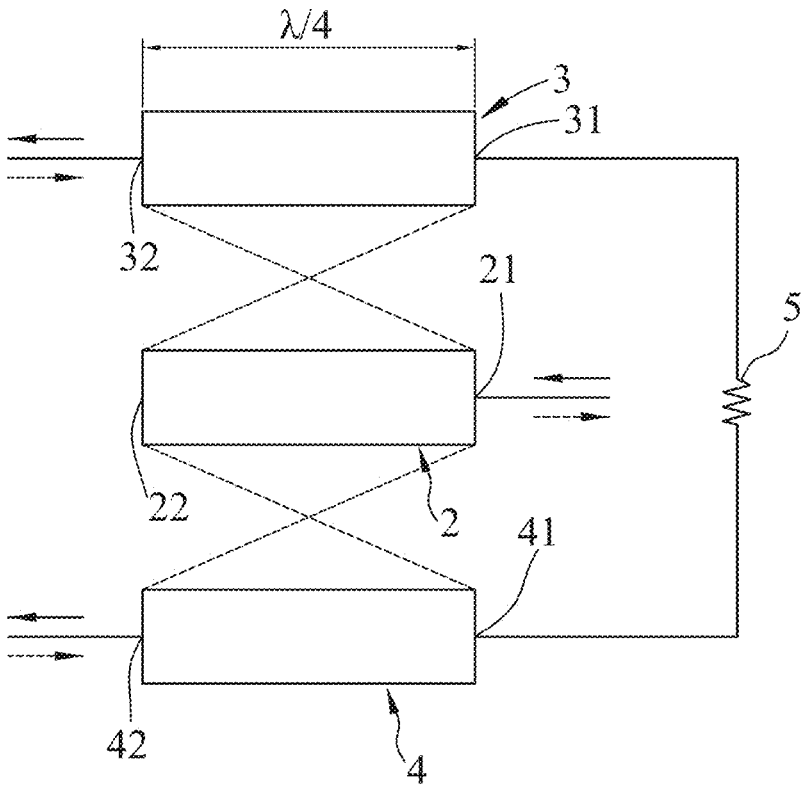
FIG. 9 is a schematic diagram illustrating a second embodiment of the power divider/combiner according to the disclosure.

Referring to FIG. 9, a second embodiment of the power divider/combiner according to the disclosure is a modification of the first embodiment, and differs from the first embodiment in that the power divider/combiner further includes a resistor 5 connected between the first terminals 31, 41 of the second transmission lines 3, 4 to thereby increase isolation between the second terminals 32, 42 of the second transmission lines 3, 4.

In view of the above, the power divider/combiner of each of the aforesaid embodiments has the following advantages.

1. Since each of the second transmission lines 3, 4 is adjacent to the first transmission line 2, and since each of the first and second transmission lines 2-4 is configured as a ring or a spiral, the power divider/combiner occupies a relatively small area and has a relatively low manufacture cost.

2. Since electromagnetic coupling is established between the first transmission line 11 and each of the second transmission lines 3, 4, power consumption of the power divider/combiner due to a substrate on which the power divider/combiner is disposed is relatively small, resulting in relatively small total power consumption of the power divider/combiner.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that the disclosure is not limited to the disclosed embodiments but is intended to cover various arrangements included within the spirit and scope of the broadest interpretation so as to encompass all such modifications and equivalent arrangements.

What is claimed is:

1. A power divider/combiner comprising:

a first transmission line having a first terminal that is for receiving or outputting a signal with a target wavelength, a second terminal that is open circuited, and a length that is a quarter of the target wavelength; and two second transmission lines, each of said second transmission lines being disposed adjacent to and spaced apart from said first transmission line so as to establish electromagnetic coupling therebetween, each of said second transmission lines having a first terminal, and a second terminal that is distal from said first terminal of said first transmission line, said second terminals of said second transmission lines being for cooperatively outputting or receiving a pair of signals that have the target wavelength and that are in-phase, each of said second transmission lines having a length that is a quarter of the target wavelength.

2. The power divider/combiner of claim 1, wherein said first terminal of each of said second transmission lines is open circuited.

3. The power divider/combiner of claim 1, further comprising a resistor that is connected between said first terminals of said second transmission lines.

4. The power divider/combiner of claim 1, wherein said first and second transmission lines are substantially coplanar, and said first transmission line is disposed between said second transmission lines.

5. The power divider/combiner of claim 4, wherein said first transmission line is configured as a ring, and each of said second transmission lines is configured as a spiral that is interwound with said first transmission line.

6. The power divider/combiner of claim 5, wherein said first transmission line is configured as a rectangular ring, and each of said second transmission lines is configured as a rectangular spiral.

7. The power divider/combiner of claim 4, wherein said first and second transmission lines have the same width.

8. The power divider/combiner of claim 4, wherein said first transmission line is equidistant from said second transmission lines.

* * * * *